United States Patent [19]

Lundberg et al.

[11] 3,950,912

[45] Apr. 20, 1976

[54] SOUND ATTENUATING WALLS

[75] Inventors: Börje Lundberg, Bandhagen; Björn Samuelsson, Solna, both of Sweden

[73] Assignee: BPA Byggproduktion AB, Stockholm, Sweden

[22] Filed: June 20, 1974

[21] Appl. No.: 481,549

[30] Foreign Application Priority Data

June 21, 1973 Sweden ..... 7308798

[52] U.S. Cl. ..... 52/727; 52/144; 52/731; 52/404

[51] Int. Cl.[2] ..... E04C 3/30; E04B 1/82

[58] Field of Search ..... 52/346, 347, 730, 731, 52/732, 241, 243, 727, 407, 406, 404, 481, 144, 145

[56] References Cited

UNITED STATES PATENTS

| | | | |
|---|---|---|---|
| 2,245,611 | 6/1941 | Schultz | 52/481 |
| 2,357,560 | 9/1944 | Taforo, Jr. | 52/145 |
| 2,924,856 | 2/1960 | Price | 52/144 |
| 3,058,551 | 10/1962 | Martin | 52/346 |
| 3,103,255 | 9/1963 | Boschi et al. | 52/145 |
| 3,423,893 | 1/1969 | Hyatt | 52/241 |
| 3,841,047 | 10/1974 | Zinn | 52/346 |

FOREIGN PATENTS OR APPLICATIONS

| | | | |
|---|---|---|---|
| 58,584 | 2/1967 | Germany | 52/145 |
| 1,084,776 | 9/1967 | United Kingdom | 52/346 |

*Primary Examiner*—Ernest R. Purser
*Assistant Examiner*—Robert Farber
*Attorney, Agent, or Firm*—Holman & Stern

[57] ABSTRACT

A sound attenuating wall comprises a skeleton frame, surface layers secured thereto, skeleton frame members, and an insulation provided between the skeleton frame members and the surface layers, respectively. The skeleton frame members are formed by two elements which in point of strength act separately of each other and are interconnected by portions of material which are weak or slender in the direction of the plane of the wall. The insulation disposed in the wall fills out only part of the space therein.

9 Claims, 6 Drawing Figures

SOUND ATTENUATING WALLS

This invention relates to a sound attenuating wall including a skeleton frame, a surface covering fixed on either side of said frame, and insulating material disposed in the space between the skeleton frame members and the surface coverings.

To impart sound attenuation ability to so-called lightwall type partition walls it is necessary at present to provide a double skeleton frame so that the surface covering on either side of the wall is supported by its respective separate frame. The two frames or skeleton frame structures should not be interconnected. In partitions where use has been made of steel columns the skeleton frame members have thus been placed in pairs, often offset laterally with respect to each other, leaving a certain space therebetween, which has been difficult in point of mounting and also entailed high costs. The double frames, however, have hitherto been considered as indispensable where requirements are placed on the sound insultation property.

One object of the present invention is to provide a skeleton frame structure which is useful for partitions of the kind contemplated and which has the same sound attenuating effect as pairs of skeleton frame members, but which may be ranked equal with single skeleton frame members in point of handling and mounting.

According to the present invention, the skeleton frame structure comprises a pair of separately acting elements each of which supports one side of a partition and which are interconnected by portions of material which are weakened or slender in a direction at right angles to the plane of the wall.

At the present time, a layer of mineral wool or like insulating material that covers the entire wall surface is utilized for the sound insulation of partitions comprising a frame and surface layers. The layer of insulating material may be of such a thickness as to fill out the entire space between the two surface layers of the skeleton frame wall, but in most cases the insulating measures are confined to the mounting of a layer covering the entire wall surface and having a thickness less than the width of the space. It should be observed that in the case contemplated the insulation is not intended to serve as heat insulation but only as sound attenuation means.

Another object of the present invention is to provide a sound attenuation which allows a considerable saving of material and labor costs and at the same time gives a sound attenuating effect that can be ranked equal with that obtained in walls of conventional design.

According to the invention, the insulating material, preferably mineral wool or like material is adapted entirely to fill out but a restricted part of each of the spaces existing between the skeleton frame members and defined by the surface coverings.

Embodiments of the invention will be described in greater detail hereinbelow and with reference to the accompanying drawing in which.

Figure 3:
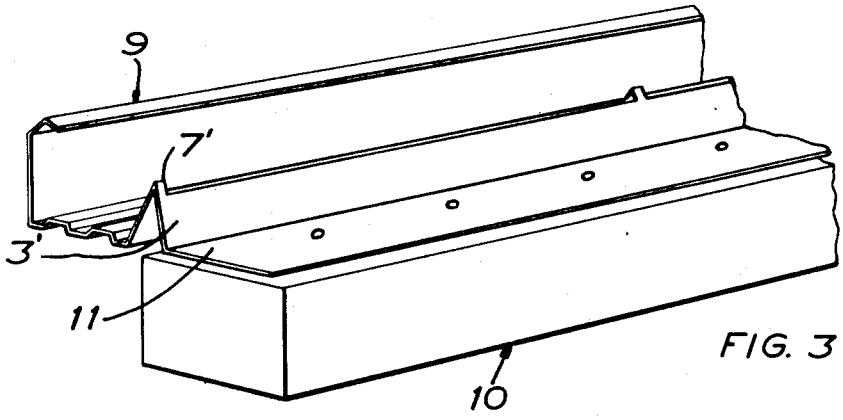
Figure 4:
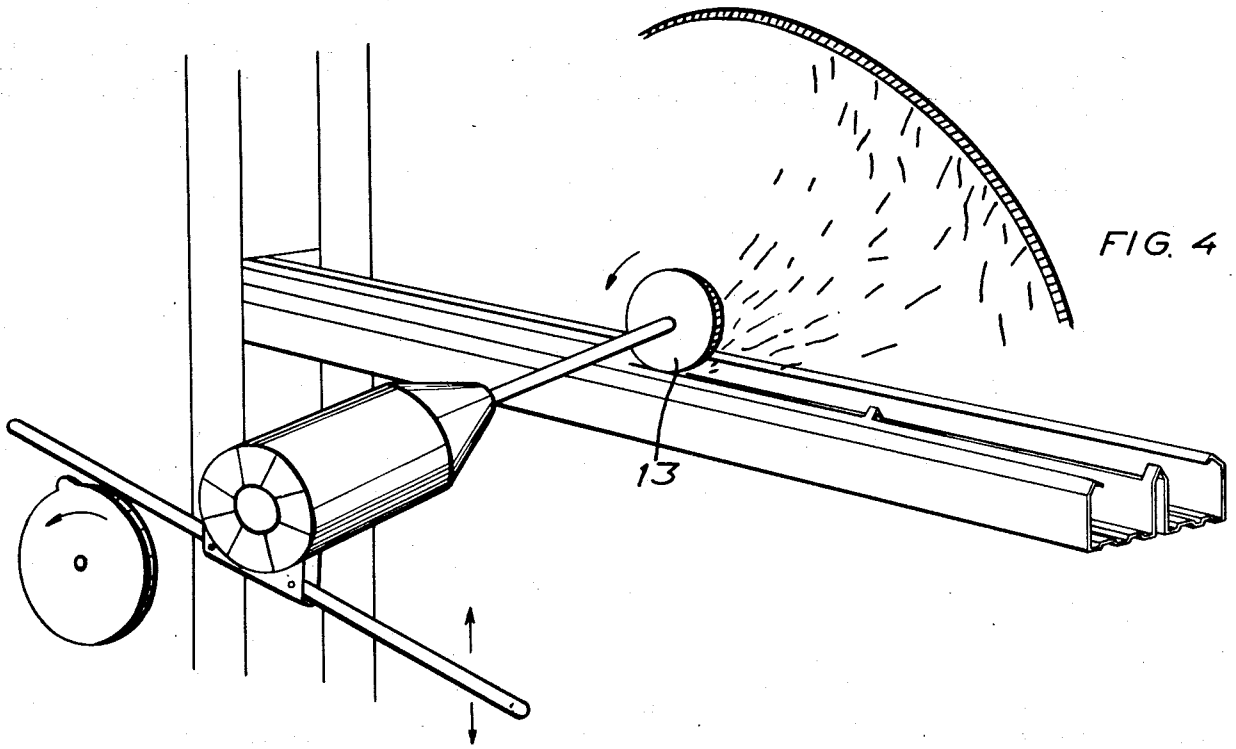
Figure 5:
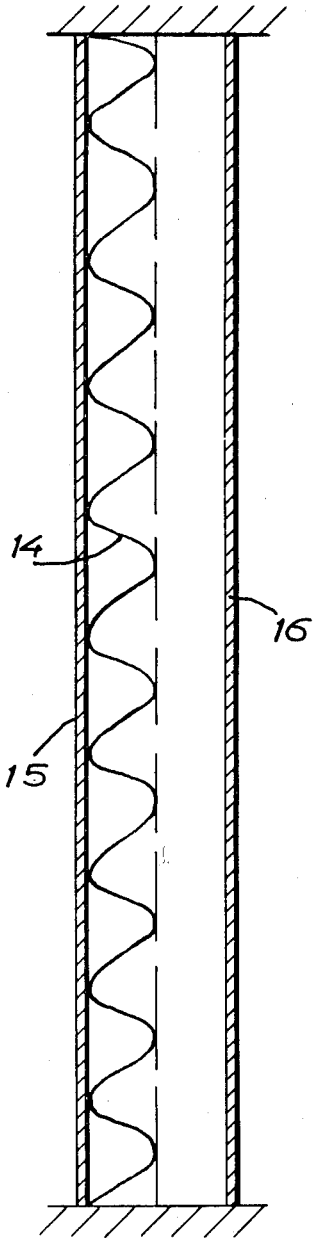
Figure 6:
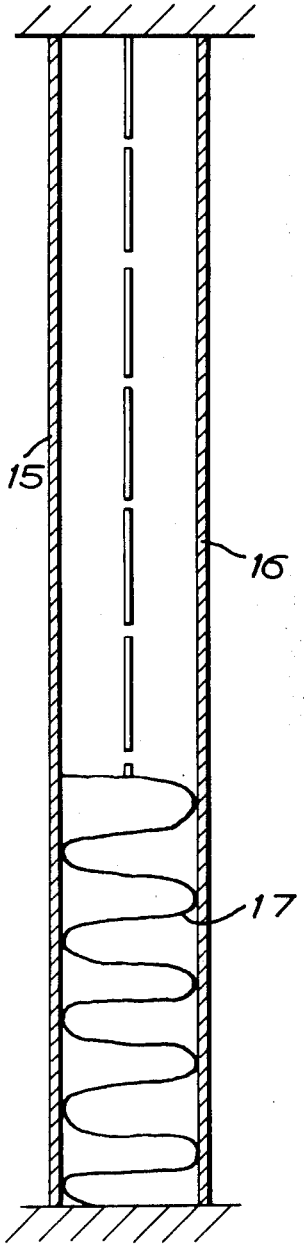

FIG. 3 diagrammatically shows a still more modified embodiment in which the sheet steel skeleton frame member is combined with a wooden skeleton frame member;

FIG. 4 illustrates how the sheet steel frame members can be manufactured;

FIGS. 5 and 6 show cross sections of walls, in which the insulation is mounted in different ways.

Figure 1:
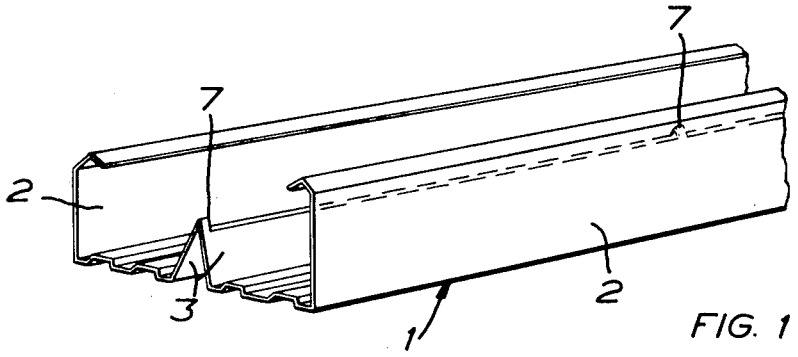
FIG. 1 is a perspective view of a design of a sheet steel skeleton frame member for a partition wall.
Figure 2:
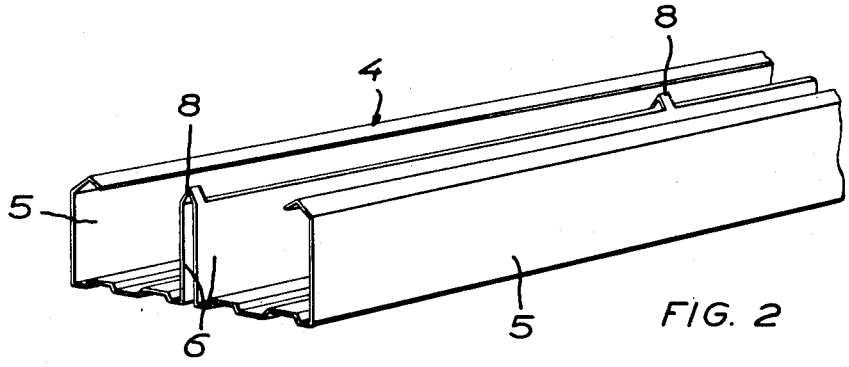
FIG. 2 is a perspective view of a modified embodiment of a sheet steel skeleton frame member.

It may be said that the skeleton frame members according to the invention consist of two halves which, as shown in FIGS. 1 and 2, may be of U-shape. The skeleton frame member illustrated in FIG. 1 has outer flanges 2 which are higher than the inner flanges 3, whereas in the skeleton frame member 4 according to FIG. 2 the outer flange 5 and the inner flange 6 have substantially the same height. The design of each half need not differ very much from that known and utilized today. According to the invention, however, the inner flanges 3 and 6 of the skeleton frame members are interconnected. In the embodiment illustrated the interconnection is realized by means of relatively narrow tongues 7 and 8, respectively.

In the embodiment illustrated in FIG. 3, the structure is composed of a sheet steel member 9 and a member 10 of wood or other material which may be incorporated as a load carrying element. This embodiment is specially suited when wood or other material is required in point of strength and is used as a load-supporting structure. By way of uses, mention may be made of facade walls, partition walls, framing of joists etc. The sheet steel member 9 substantially corresponds to one half of the member shown in FIG. 1, but instead of the other half the flange 3′ merges into a planar portion 11. The member of wood or other material may be a conventional wood element, a sheet steel beam or other element suitable in point of strength, which is secured to the portion 11.

The connection between the two flanges 3′ is realized also in this case by means of tongues 7′.

The skeleton frame structure according to the invention can suitably be produced in a conventional bending process, in which the transition between the two halves of the structure is left unbroken. The material between the tongues 7 and 8 may be removed, as illustrated in FIG. 4, by means of a cam-controlled grinding wheel 13 or like means.

The skeleton frame structure can also be produced in a pressing operation, in which case the material between the tongues 7 and 8 can be removed by grinding or punching.

It should be mentioned that the embodiment in which tongues of materials are left in place, is not the only one possible. Instead of providing spaced tongues it is possible to reduce the thickness of the metal sheet at the very transition between the halves of the skeleton frame member, for instance by partially grinding away material or by providing one or more pressed-in grooves along the portion of transition.

The sound attenuating transition between the flanges can also be realized by making the flanges connecting the halves of the skeleton frame member together, considerably wider than those illustrated. By extending the inner flanges the skeleton frame structure will have an increased bending resistance but at the same time the advantage is gained that its sound attenuation property increases. The interconnected inner flanges will in fact act as levers, whereby the two halves of the skeleton frame structure will be resiliently interconnected via the portion of transition between the flanges. Thus it will be more difficult for vibrations in one half of the structure to pass over into the other half. The embodiment illustrated in the drawing and described above will be the most suitable one, as far as can be judged at present.

As a rule, an insulating layer is arranged in sound attenuating partition walls along the entire wall surface as is indicated at 14 in FIG. 5. The insulation is allowed to fill out the entire space between the outer sides 15 and 16 of the wall. Usually, however, the space is not entirely filled out. The structure according to the invention at one and the same wall thickness provides a higher sound isolation which — for reaching a certain sound insulation level — permits a great simplification of the design of the insulation inside the wall between the coverings, thereby making the construction less expensive both in point of material and labor. It has proved that at least as good a sound insulating property can be obtained as in prior art structures, if, as shown at 17 in FIG. 6, the entire space between the walls is filled out only up to a certain level and the remaining space between the wall surfaces is left empty. This implies that a considerable saving of insulating material can be made, and moreover, the mounting of the wall will be facilitated as it is possible to mount the insulation in a simpler way when a complete coverage of the entire wall surface is not required.

Of course, it need not be the lower portion of the wall space that is filled out. It is conceivable to arrange the insulation somewhere at the middle portion of the wall or at the upper portion of the space. However, for several reasons, an insulation provided at the bottom will be preferable int. al. in point of mounting.

The insulation can be mounted in a very simple manner in that the insulating material — without the use of scaffolds — can be mounted from floor level. As insulating material use can be made of bulk material which is considerably cheaper than material in the form of mats. As distinct from a mounting over the entire wall surface no fastening devices are required for the insulation. The necessary quantity of insulating material will be less than that required for an insulation arranged in a conventional manner.

Experiments have shown that a space between two skeleton frame members and their surface coverings should be filled out completely with insulating material up to about two fifths whereas the remaining space is left unfilled.

While the invention has been described with particular reference to the embodiments described above and illustrated in the drawing, those skilled in the art will realize that the invention can be modified in several ways within the spirit and scope of the appended claims.

What we claim and desire to secure by Letters Patent is:

1. A sound attenuating wall including members defining a skeleton frame, and surface coverings fixed on each side of said frame, wherein at least one of the members defining the skeleton frame comprises a pair of separately acting elements interconnected by portions of material which are weakened or slender in a direction at right angles to the plane of the wall, and wherein each element has a flange portion projecting essentially in a direction parallel to the plane of the wall, the edges of said flanges remote from the element being interconnected by the weakened or slender material portions.

2. The sound attenuating wall as claimed in claim 1, wherein the two elements are integral U-sections, and adjoining flange portions of the respective section are interconnected at their outer edges by means of weakened material portions.

3. The sound attenuating wall as claimed in claim 1, wherein one element of the member is a U-shaped sheet steel section whereas the other element of the member is a stud of wood having a sheet steel flange strip secured thereto, and wherein a flange portion of the first mentioned element is connected, via weakened or slender portions of material, with the flange strip secured to the other element.

4. The sound attenuating wall as claimed in claim 2, wherein the weakened portions of material interconnecting the elements of the skeleton frame members are formed by tongue-shaped portions integral with the adjoining flanges.

5. The sound attenuating wall as claimed in claim 2, wherein the weakened portions of material interconnecting the adjoining flanges of the two elements of the frame members are thinned.

6. The sound attenuating wall as claimed in claim 1 further including sound insulating or absorbing material disposed in the space between the skeleton frame members and the surface coverings, the sound insulating or absorbing material being adapted entirely to fill out but a restricted portion of each of the spaces existing between and defined by the skeleton frame members and the surface coverings.

7. The sound attenuating wall as claimed in claim 6, wherein the insulating material is mounted in the lower portion of the space inside the wall.

8. The sound attenuating wall as claimed in claim 6, wherein the insulating material fills out approximately two fifths of the otherwise unfilled space.

9. The sound attenuating wall as claimed in claim 6, wherein the insulating material is mineral wool.

* * * * *